US009464628B2

(12) United States Patent
Mueller et al.

(10) Patent No.: US 9,464,628 B2
(45) Date of Patent: Oct. 11, 2016

(54) PUMP

(71) Applicant: Thomas Magnete GmbH, Herdorf (DE)

(72) Inventors: Axel Mueller, Slegen (DE); Olaf Ohligschlaeger, Gruenebach (DE); Stefan Quast, Wingendorf (DE); Michael Feckler, Herdorf (DE)

(73) Assignee: Thomas Magnete GmbH, Herdorf (DE)

( * ) Notice: Subject to any disclaimer, the term of this patent is extended or adjusted under 35 U.S.C. 154(b) by 326 days.

(21) Appl. No.: 13/627,323

(22) Filed: Sep. 26, 2012

(65) Prior Publication Data

US 2013/0034459 A1 Feb. 7, 2013

Related U.S. Application Data

(63) Continuation of application No. PCT/DE2011/000284, filed on Mar. 18, 2011.

(30) Foreign Application Priority Data

Mar. 26, 2010 (DE) ..... 10 2010 013 106

(51) Int. Cl.
*F04B 17/04* (2006.01)
*F04B 35/04* (2006.01)
(Continued)

(52) U.S. Cl.
CPC ..... *F04B 17/048* (2013.01); *F04B 17/046* (2013.01); *F04B 53/001* (2013.01); *F04B 53/10* (2013.01); *F04B 35/045* (2013.01);
(Continued)

(58) Field of Classification Search
CPC .... F04B 35/045; F04B 17/04; F04B 17/048; F04B 39/0027; F04B 39/1013
USPC ..... 417/416, 417, 540, 567, 569, 571; 137/528, 535, 540, 541, 542, 543.13
See application file for complete search history.

(56) References Cited

U.S. PATENT DOCUMENTS 2,112,232 A * 3/1938 Stoll ..... 123/188.8
2,962,304 A * 11/1960 Lung ..... 285/48
3,380,387 A 4/1968 Kofink
(Continued)

FOREIGN PATENT DOCUMENTS

AU 417351 B2 11/1968
DE 4035835 A1 5/1992
(Continued)

OTHER PUBLICATIONS

International Search Report dated Jan. 19, 2012 for International Application No. PCT/DE2011/000284. 11 Pages.

*Primary Examiner* — Devon Kramer
(74) *Attorney, Agent, or Firm* — Eschweiler & Associates, LLC

(57) ABSTRACT

The invention relates to a pump for pumping a fluid, including an inlet, an outlet, and a pumping chamber, wherein a valve is arranged between the inlet and the pumping chamber or between the pumping chamber and the outlet. The valve includes a valve body having a valve seat pointing in the direction of the outlet, and a valve member that interacts with the valve seat, wherein the valve member is loaded under pre-loading against the valve seat into a closed position of the valve and allows fluid to pass through in a pumping direction due to the valve member lifting off against the pre-load, wherein the valve body is accommodated in a receptacle of a pump part. A pump for which the development of noises and vibrations is reduced in that the valve body can move axially relative to the receptacle that accommodates the valve body.

5 Claims, 3 Drawing Sheets

(51) Int. Cl.
*F04B 53/00* (2006.01)
*F04B 53/10* (2006.01)

(52) U.S. Cl.
CPC *F04B2201/0604* (2013.01); *F04B 2203/0406* (2013.01)

(56) References Cited

U.S. PATENT DOCUMENTS

| | | | | |
|---|---|---|---|---|
| 4,389,169 | A * | 6/1983 | De Dionigi | 417/417 |
| 4,743,179 | A * | 5/1988 | Waas et al. | 417/417 |
| 6,019,124 | A * | 2/2000 | Sebion et al. | 137/454.4 |
| 6,681,806 | B2 * | 1/2004 | Isobe | 137/625.65 |
| 7,178,787 | B2 * | 2/2007 | Gilbert et al. | 251/337 |
| 7,290,559 | B2 | 11/2007 | Nieslony et al. | |
| 2005/0063841 | A1 * | 3/2005 | Chen et al. | 417/417 |
| 2005/0089418 | A1 * | 4/2005 | Bonfardeci et al. | 417/417 |
| 2006/0039811 | A1 | 2/2006 | Nieslony et al. | |

FOREIGN PATENT DOCUMENTS

| | | | |
|---|---|---|---|
| DE | 4205290 | A1 | 8/1993 |
| DE | 102006019584 | A1 | 11/2007 |
| DE | 102008013440 | A1 | 9/2009 |
| EP | 1748188 | A1 | 1/2007 |
| EP | 1748188 | B1 | 9/2008 |
| WO | 9935399 | A1 | 7/1999 |
| WO | 2004109093 | A1 | 12/2004 |

* cited by examiner

PUMP

REFERENCE TO RELATED APPLICATIONS

This Application is a continuation of International Application number PCT/DE2011/000284 filed on Mar. 18, 2011, which claims priority to German Application number 102010013106.7 filed on Mar. 26, 2010.

FIELD

The invention relates to a pump.

BACKGROUND

DE 10 2006 019 584 A1 reveals an electromagnetic pump designed as a reciprocating piston pump. A check valve is provided on the outlet side, with a valve body which is inserted fixedly between an outlet connection and a metering cylinder guiding a piston rod as well as an outlet flange. A disadvantage in this case is that impacts of the piston rod against the valve body cause noise and introduce vibration into the entire pump.

EP 1 748 188 A1 reveals an electromagnetic pump which is designed as a reciprocating piston pump and in which a check valve is provided on the outlet side. A valve body of the check valve is fixedly inserted in a metering cylinder interacting with a piston rod. In the event of contact between the piston rod and valve body, undesirable vibration and noise are produced, and these are only inadequately mitigated by a provided impact-damping surface.

DE 42 06 290 A1 reveals a solenoid-operated pump, the inlet side of which is sealed by a suction valve. The solenoid-operated pump comprises a magnetically displaceable armature piston with a piston rod, which, when a coil is energized, are displaced together in the direction of the suction valve and, when the coil is de-energized, eject liquid and carry out suction via the suction valve. The suction valve comprises a valve body which is accommodated in an axially nondisplaceable manner in a receptacle in a core flange, and which has a central bore through which liquid can pass from an antechamber into a guide sleeve guiding the piston rod. A disadvantage in this case is that, when the coil is energized, the end side of the piston rod strikes against the valve body and therefore noise is generated and vibration introduced into the pump. Another disadvantage is that, when the coil is de-energized, the liquid is guided exclusively via the central bore, and therefore a comparatively high negative pressure arises in the guide sleeve, and may form a counter force to the resetting movement of the armature piston.

SUMMARY

It is the object of the invention to provide a pump in which the generation of noise and vibration is reduced.

The pump according to the invention, which, in one embodiment, is an electromagnetic pump, arranges a delivery chamber between an inlet and an outlet, wherein, in order to obtain a required pumping power between the inlet and the delivery chamber and/or between the delivery chamber and the outlet, a valve is provided. The valve has a valve body, the valve seat of which points in the outlet direction, i.e. in the delivery direction of the pump, and therefore the valve member interacting with the valve seat substantially prevents delivered fluid from returning counter to the delivery direction. In this case, the valve member is loaded under prestressing against the valve seat in order to reach a closed position and opens up the passage of fluid in the delivery direction by lifting off counter to the prestressing, for example, of a spring. The valve body is accommodated in a receptacle in a pump part, for example, in a receptacle of a core flange, of a connector, or of a part, such as a bushing or a guide sleeve, accommodated in one of the abovementioned parts. The valve body here is also axially displaceable with respect to the receptacle accommodating the valve body, during operation of the pump, and therefore the valve body can recede upon contact with a movable pump part, which is different from the valve, in particular a piston rod or an armature piston of the drive. By this means, the force or energy which is otherwise introduced into the valve body upon impact of the movable part is not converted into noise, vibration, oscillations and/or heat, but rather into an axial movement of the valve body. The effect is therefore advantageously achieved that the pump runs in a low-vibrating and quiet manner and therefore the service life of the pump as a whole is increased. In particular in the case of pumps with a variable stroke frequency, the occurrence of resonant vibration subjecting the components to a particular amount of stress is therefore advantageously also cost-effectively and reliably avoided. It is therefore possible reliably to operate a correspondingly equipped pump even within problematic frequency ranges.

The valve body is assigned, in one embodiment, a flexible damping arrangement which loads the valve body into a starting position. In this connection, the starting position of the valve body corresponds to that end position which is expediently delimited by a stop in the receptacle in the pump part and which is taken up by the valve body when the drive is de-energized. If, when the drive is energized, a piston rod is displaced in the direction of the valve body, the valve body is capable of carrying along the final section of the axial displacement of the piston rod by loading the latter, wherein the flexible damping arrangement is correspondingly elastically reversibly compressed, deformed or tensioned. After the drive is de-energized, the damping arrangement causes the resetting of the valve body back into the starting position thereof in the manner of a spring. The displacement distance of the valve body here expediently makes up less than half of the axial strength of the damping arrangement, and therefore the latter can be configured with a rigidity which reliably resets the valve body. The axial displacement distance of the valve body, and therefore the amount of axial displaceability, does not make up more than a quarter of the axial strength of the damping arrangement, in one embodiment, in particular not more than an eighth. The damping arrangement expediently has the same axial strength as that circumferential section of the valve body which is guided in the receptacle. The damping arrangement therefore stores displacement energy of the piston rod and therefore damps noise and vibration.

The return stoke of the piston rod already causes a negative pressure at the outlet end side of the valve body which, depending on the arrangement of the valve, lifts the valve member off the valve seat, in the case of a suction valve, or additionally sucks the valve member in the direction of the valve seat, in the case of a check valve arranged on the outlet side. The negative pressure may furthermore be used—in addition to the damping arrangement or by itself—as a resetting force for the axial displaceable valve body as a whole, since the negative pressure occurs during the return stoke of the piston rod, and therefore the negative pressure can reset the valve body as a whole. For this purpose, a cylindrical recess may advantageously be formed in the end side facing the piston rod, the recess being matched to the diameter of the piston rod and, without impairing the valve function, assisting in suction of the entire valve body.

According to an expedient refinement, provision is made for the damping arrangement to comprise an elastomer ring which may be designed in the manner of an O ring or the like. In this case, the elastomer ring is expediently supported at one end on a corresponding bearing surface of the valve body and is supported at the other end on an abutment which is axially immovable in relation to the receptacle accommodating the valve body. In addition to the elastomer ring, the damping arrangement, in one embodiment, also comprises further parts, for example a damping plate, which can be formed from plastic or metal and can expediently be arranged on that side of the elastomer ring which faces away from the supporting surface of the valve body. Alternatively or accumulatively, it is possible for the damping arrangement to comprise a spring, for example a disk spring, which prestresses the valve body back into the starting position thereof.

It is possible to fix the damping arrangement to the valve body, for example by the damping arrangement being fixed in a form-fitting or frictional manner to a section of the valve body. It is possible in particular to vulcanize or shrink the elastomer ring onto the valve body, wherein this may take place integrally or from the same material as other elastomer surfaces attached to the valve body, for example a lining for the valve seat or an impact-damping surface. The valve body is expediently equipped on the radial circumference, at which the valve body is guided in the receptacle, with a sliding coating or the like, for example Teflon, in order to avoid sticking or tilting. It is alternatively possible to provide an arrangement in the manner of a bearing bushing or a bearing for this purpose.

The abutment, against which the damping arrangement is supported, is expediently designed as a calking ring in one embodiment which has a central hole through which one end of the valve body can protrude axially into an antechamber in that region of the pump which is mounted upstream of the core flange. In the case of the configuration of the valve as a suction valve on the inlet side of the pump, an eccentric perforation may also be provided next to the central hole in the calking ring, the perforation permitting a fluid connection between the antechamber and an inner region of the pump or of the core flange, thus providing two paths for guiding fluid into the inner region of the pump. Excessive negative pressures are thereby advantageously avoided.

By contrast, if the valve is used on the outlet side, a bypass is undesirable, since the check valve is then intended reliably to avoid not only the return of liquid but also of gases. In this case, it is expedient if the radial receptacle of the valve body is encased by an elastomer material which permits axial moveability, but at the same time ensures an at least liquid-tight, also a gas-tight sealing in one embodiment with respect to the receptacle.

In the case of a suction valve arranged on the inlet side, the insertion of the piston rod in the guide sleeve is required in order to provide a negative pressure, which lifts off the valve member, on that side of the valve body which faces away from the inlet. The axial movability of the valve body therefore permits the formation of the pump in such a manner that the piston rod enters into contact with the valve body and is therefore of a particularly small size. Furthermore, the axial distance between the valve body and piston rod is within the range of zero, and therefore the negative pressure is achieved early and reliably during the resetting of the piston.

In the case of a check valve on the outlet side, in which the valve seat faces the outlet and the valve member is prestressed in the direction of the inlet, the effect which can advantageously be achieved, in particular in the case of a metering pump, in which a piston rod is guided in a metering cylinder, is that the piston rod is designed in such a manner that said piston rod strikes against the valve body and displaces the latter axially for a distance, and therefore the entire volume of the metering cylinder can be ejected through the valve. In this case, the negative pressure arising during the return stroke of the piston rod in the region of the metering cylinder advantageously acts as an additional resetting force on the valve body after the valve member has entered into contact against the valve seat, and therefore a damping arrangement may be omitted under some circumstances.

Further advantages, properties and developments of the invention emerge from the description below of a preferred exemplary embodiment and from the dependent claims.

DETAILED DESCRIPTION

Figure 1:
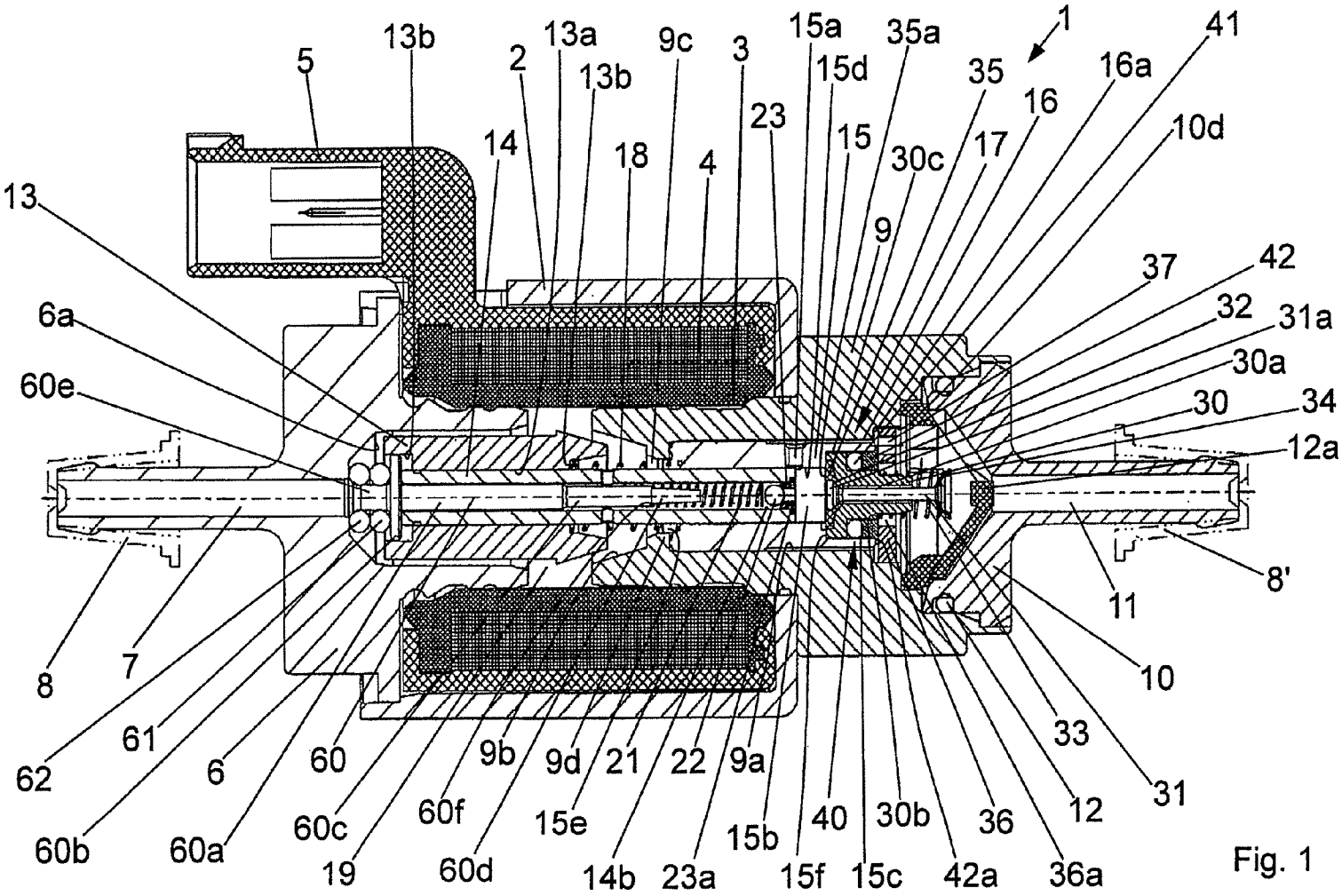
FIG. 1 shows a longitudinal section through one embodiment of a pump according to the invention.

The pump, which is denoted as a whole by 1 in FIG. 1, is designed as a solenoid-operated pump which, in design, is a through-feed pump. The pump is constructed modularly in a simple manner and, as a result, can easily be fitted. The pump comprises a solenoid-operated drive which is accommodated in a housing 2, wherein the housing 2 surrounds a bobbin 3 on which a coil 4 is wound. The coil can be connected to a voltage supply via a connecting region 5 guided out of the housing 2.

An output flange 6 is calked into the housing 2 on the output side, the output flange substantially limiting the end side of the housing 2 on the output side and having an outlet channel 7 through which the liquid to be delivered is to be ejected. A closure cap for the outlet channel 7 is shown by dash-dotted lines at 8. The output flange 6 forms an outlet of the pump 1.

On the input side, a solenoid-conducting core flange 9 is pressed into the housing, the core flange having an inner section with a smaller diameter, which can be inserted into the inner region of the bobbin 3, and the core flange having an outer section with a larger diameter, which protrudes from the housing 2. An inlet connection 10 is inserted into the core flange 9, on the side thereof which faces away from the housing 2, the inlet connection having an inlet channel 11 through which liquid which is to be supplied can pass. In one embodiment, the outer circumference of the inlet connection 10 is provided with an external thread which, together with an internal thread in a projecting annular region of the core flange 9, permits the connection. The inlet connection 10 is sealed off from the core flange 9 with a seal 12. An integral filter **12*a* which is produced from mesh insert-molded with plastic, is inserted between the inlet connection 10 and the core flange 9. A closure cap for the inlet channel 11 is shown by dash-dotted lines at 8'. The core flange 9 and the inlet connection 10 form an inlet of the pump 1**.

The output flange has an approximately cylindrical central recess 6*a* in which the armature piston 13 of a drive unit which comprises the armature piston 13 and a piston rod 14 fixed in a cutout 13*a* in the armature piston 13, is accommodated in an axially displaceable manner. The armature piston 13 and the piston rod 14 are calked to each other in one embodiment. In FIG. 1, the armature piston 13 is in the output position thereof, which is taken up when the coil 4 is de-energized.

The piston rod 14 has a continuous central bore 14*b*. An insert member 60 is inserted into the central bore 14*b* from the direction of the outlet, the insert member having a cylindrical main section 60*a* which adjoins a fastening section 60*b*, which is likewise designed as a flange. The fastening section 60*b* is calked in a hollow-cylindrical receptacle 13*b* in the armature piston 13, the receptacle being wider than the cutout 13*a*. On that side of the main section 60*a* which lies opposite the fastening section 60*b* the main section is continued by a tapered section 60*c* which itself merges into a conical centering pin 60*d*. The cylindrical extension 60*e*, which is concentric with the remaining sections and on which a sealing ring 61 sits in the impact region with the fastening section 60*b*, protrudes on that side of the fastening section 60*b* which lies opposite the main section 60*a*. A further sealing ring 62 which is identical to the sealing ring 61 is arranged at the opening of the outlet channel 7 into the central recess 6*a*. In the starting position of the armature piston 13, the two sealing rings 61, 62 bear against each other, and the extension 60 penetrates for a distance into the sealing ring 62, thus separating the outlet channel 7 from the central recess 6*a* in a substantially tight manner. Furthermore, the sealing rings 61, 62 damp the impact of the moving parts.

Figure 2:
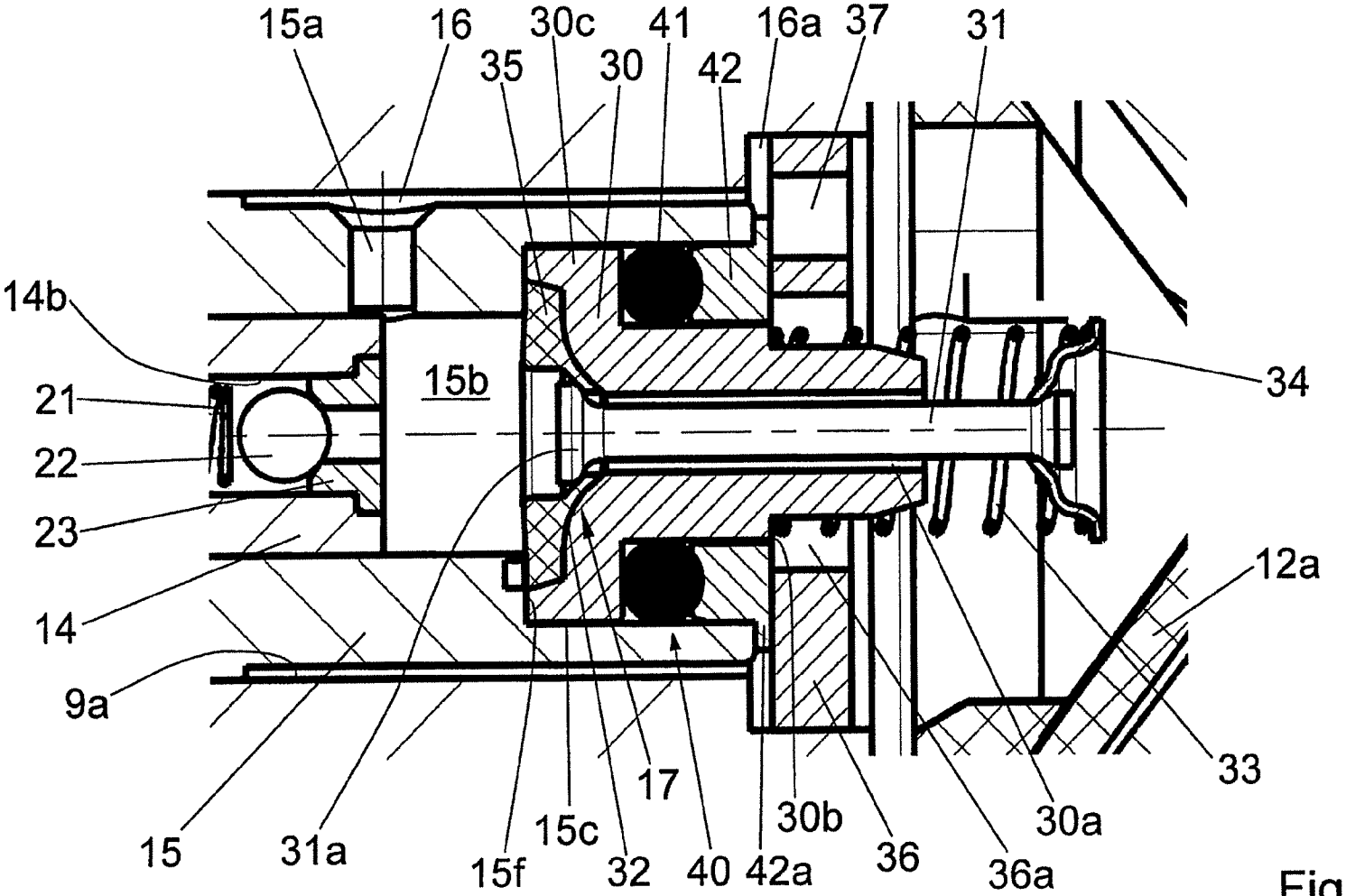
FIG. 2 shows an enlarged detail of the longitudinal section through the pump according to FIG. 1.

The core flange 9 has a central recess 9*a* facing the inlet connection 10, and, at its end facing the armature piston 13, has a conically tapering conical receptacle 9*b* matched to the conical shape of that end side of the armature piston 13 which faces away from the outlet, wherein the recess 9*a* and the conical receptacle 9*b* are separated from each other by a constricting web section 9*d* opening up a passage opening 9*c*. A guide sleeve 15 which has a central bore 15*d*, into which the piston rod 14 can penetrate, is inserted into the recess 9*a*. In this case, a cylindrical annular section 15*e* of the guide sleeve 15 projects into the web region 9*d* and thus centers the guide sleeve in the passage opening 9*c*. The guide sleeve 15 has a radial intake 15*a* which opens into an annular gap region 16 between the core flange 9 and the guide sleeve 15 and therefore produces a connection between an inner region 15*b* of the guide sleeve 15 and the annular gap 16. The guide sleeve 15 furthermore has a recess 15*c*, which faces the inlet connection 10, in the form of annular step which widens the bore 15*d* and into which a valve arrangement 17, which is explained in more detail below, can be inserted. In FIG. 2, this region of the pump 1 is enlarged and therefore illustrated so as to be better recognizable. It can be seen that the recess 15*c* forms a receptacle for the valve 17, the receptacle being provided in a pump part, in the present case in the guide sleeve 15. It has to be understood that a receptacle of this type may also be provided in another pump part.

A compressing spring 18 is supported against that end side of the guide sleeve 15 which faces the armature piston 13, or against the web section 9*d*, the compression spring bearing with its opposite end against an end region of the armature piston 13, which end region defines a shoulder 13*b*, and therefore prestressing the armature piston 13 in the outlet direction.

In the region not filled by the insert member 60, the central bore 14*b* of the piston rod 14 creates a fluid connection between the inner region 15*b* and a delivery chamber 19, which is bounded by the output flange 6, the core flange 9 and the bobbin 3 of the housing 2. For this purpose, the piston rod 14 has radial connecting bores 14*a* which, in the region of that end side of the armature piston 13 which faces the inlet, produce a connection between the central bore 14*b* of the piston rod 14 and the delivery chamber 19.

A resetting spring 21 is supported on an annular step 60*f* of the insert member 60, the resetting spring being designed as a helical spring, surrounding the centering pin 60*d* and supporting a valve ball 22 against a valve seat 23 provided in the outlet end side of the central bore 14*b* of the piston rod 14. The valve seat 23 is in the form of a flange and is pressed into the central bore 14*b* in such a manner that the end side of the valve seat is aligned with the inlet end side of the piston rod 14 and does not protrude axially beyond the latter.

The valve arrangement 17 is designed as a suction valve and has a valve body 30 which has a central continuous valve 30*a* in which a valve member tappet 31 is displaceable axially. A depression which defines a valve seat 32 and is lined by an elastomer material 35 is formed on one end side of the valve body 30, which end side faces the armature piston 13. The elastomer material 35 lines the valve seat, but at the same time forms an impact-damping surface 35*a* for the inlet end side of the piston rod 14, which side strikes against the surface during operation of the pump.

At that end of the valve member tappet 31 which faces the armature piston 13, the valve member tappet has a stop surface 31*a* which widens radially outward and turns out to be larger than the valve bore 30*a* of the valve body 30, and therefore forms a valve member for closing the valve arrangement when the valve member is pulled against the valve seat 32 under the prestressing of a preloading spring 33 designed as a helical spring. For this purpose, the preloading spring 33 is supported at one end against an annular region 30*b* of the valve body 30 and at the other end against an attachment part 34, which is connected to that end side of the valve member tappet 31 which faces away from the armature piston 13. The preloading spring 33 therefore loads the valve member 31*a*, via the attachment part 34 and the valve member tappet 31, toward the valve seat 32 into a closed position such that the valve arrangement 17 forms a check valve counter to the inlet direction. This design of the valve arrangement 17 has the advantage that, at least in the closed state of the valve arrangement 17, the valve member 31*a* does not protrude beyond that end side of the valve body 30 which is on the piston-rod side.

A calking ring 36 is calked radially in a step 10*d* of the inlet connection 10 and therefore forms a frictional abutment against the guide sleeve 15 sliding out of the recess 10*a*. The calking ring 36 has a central hole 36*a* through which the valve body 30 protrudes in the direction of the inlet connection 10, and an eccentric perforation 37 which is intended for a fluid connection in a radial region toward the annular gap 16. A fluid connection between the annular gap 16 and the perforation 37 takes place through a connecting region 16*a*.

A damping arrangement 40 is arranged between the calking ring 36 and a step 30*a* of the valve body 30, the damping arrangement comprising an elastomer ring 41 (shown in black in FIG. 2) which is designed in the manner of an O ring and is supported directly on the step 30*a*, and a damping plate 42 which is formed from a plastic and is supported against the calking ring 36. A radial extension 42*a* of the damping plate 42 penetrates here between the end side of the sliding sleeve 15 and the calking ring 36. The damping plate 42 may also be produced from metal or another material suitable as a spacer. In particular, it is also possible, given appropriate dimensioning of the elastomer ring 41, to entirely dispense with the damping plate 42.

The valve body 30 has a cylindrical circumferential surface section 30*c* which is matched to the diameter of the recess 15*c*, wherein the outside diameter of the circumferential surface section 30*c* is approximately aligned with that of the damping region 40. In this case, the circumferential surface section 30*c* is not calked in the recess 15*c* but rather is axially displaceable with respect thereto. The damping arrangement 40, owing to the elastic property thereof, prestresses the valve body 30 here against the corresponding annular shoulder 15*f* of the guide sleeve 15 in the direction of the outlet. It is possible to also design the damping arrangement 40 as a spring member. As an alternative, it is also possible to entirely or partially injection mold the damping arrangement 40 onto the valve body 30.

Figure 3:
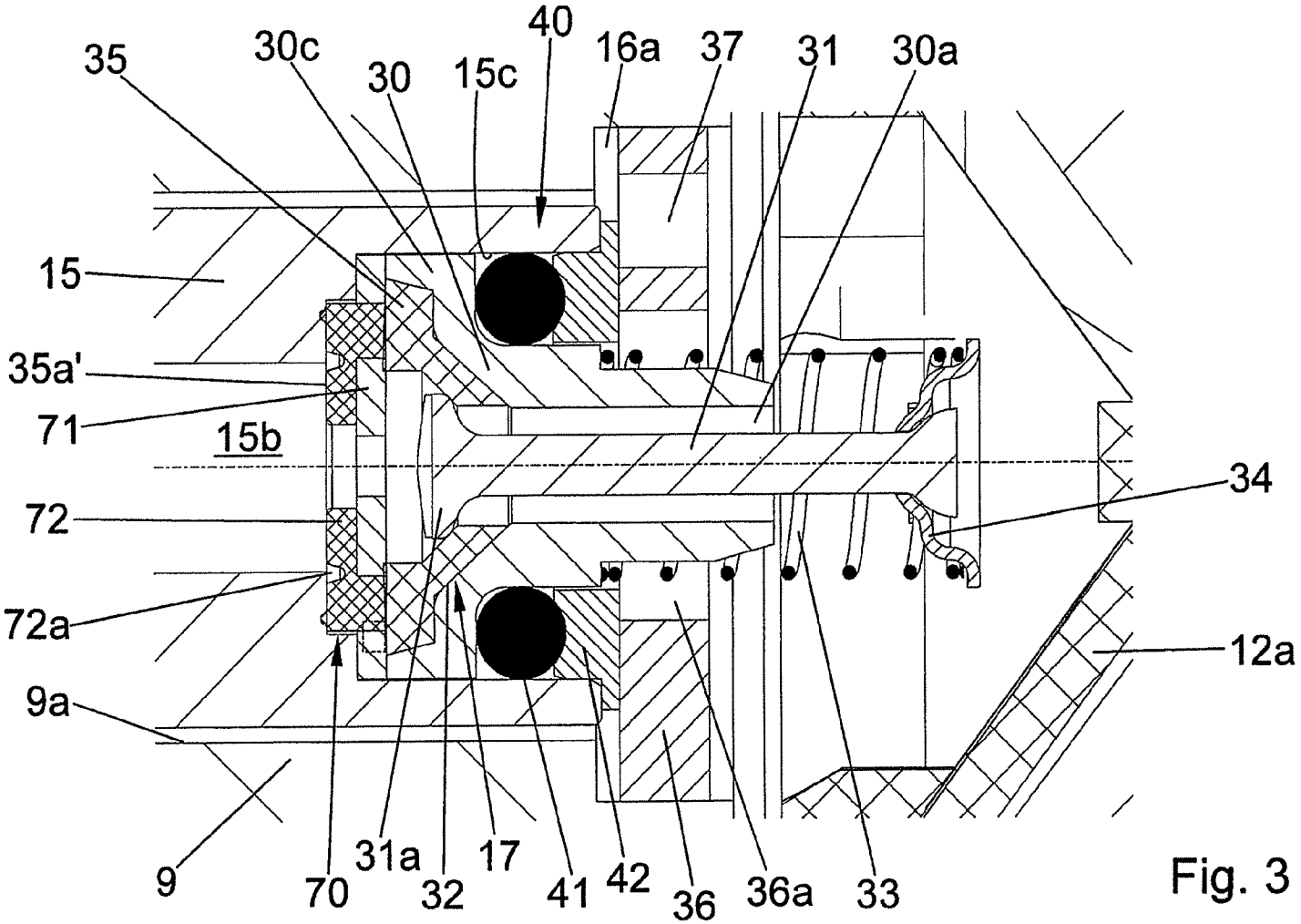
FIG. 3 shows an alternative configuration of the pump according to FIG. 1.

FIG. 3 illustrates an alternative configuration to that from FIGS. 1 and 2, in which the same reference numbers as in FIGS. 1 and 2 denote the same or structurally comparable parts. In contrast to FIG. 1, the elastomer lining of the depression defining the valve seat 32 and the impact damping surface 35*a* are not formed from an integral elastomer material 35, but rather a separate insert 70 which forms an impact-damping surface 35*a*', is different from the elastomer material 35 and has a support body 71 made of metal or plastic and an elastomer casing 72 which is fitted on the latter and has an expansion ring recess 72*a* is provided for this purpose. The elastomer casing 72 is vulcanized or shrunk onto the support body 71 and surrounds the latter, in particular radially, and on the end side pointing toward the piston rod 14. The insert 70 has a continuous opening in the center. This may improve the tightness of the suction valve, since the elastomer material 35 of the valve seat 32 is then not stressed mechanically by impacts.

The exemplary embodiment according to the invention now functions as follows:

If the coil 4 is energized, the armature piston 13 is displaced together with the piston rod 14 in the direction of the inlet connection 10. By means of the liquid stored in the interior region 15*b*, the valve ball 22 is reset counter to the prestressing of the resetting spring 21 and the liquid penetrates into the central bore 14*b* in the piston rod 14 and passes via the radial connecting bores 14*a* into the delivery chamber 19. If the coil 4 is then de-energized, the armature piston 13 together with the piston rod 14 is displaced under the prestressing of the spring 18 in the direction of the output flange 6, the overflow valve 22/23 closes and the liquid, which is loaded by the return stroke in the delivery chamber 19 is pressed into the outlet channel 7. During the return stroke of the armature piston 13 and piston rod 14, a negative pressure is produced in the region of the interior region 15*b* in the sliding sleeve 15, which results in the valve member 31*a* together with the valve member tappet 31 being lifted off the valve seat 32 counter to the prestressing of the preloading spring 33, and therefore liquid can flow through an annular gap 50 between the valve member tappet 31 and the valve bore 30*a* of the valve body 30. If the pressure is equalized, the valve member 31*a* is reset against the valve body 32 under the force of the preloading spring 33.

The energization of the coil 4 results in a vigorous deflection of the drive unit comprising the armature piston 13 and piston rod 14, wherein, owing to the short or absent distance between the inlet end side of the piston rod 14 and the impact-damping surface 35*a* the piston rod 14 strikes against the valve body 30. Even at low energization frequencies, and all the more at high energization frequencies, undesirable vibration and noise arise, which can only be partially damped by the impact-damping surface 35*a* comprising the elastomer material and which are absorbed by the damping arrangement 40.

Owing to the axial displaceability of the valve arrangement 17 in the recess 15*c* which is bounded by the calking ring 36, undesirable vibration and noise are reduced further and are absorbed by the damping arrangement 40. If, after de-energizing of the coil 4, the valve arrangement 17 is displaced back by the damping arrangement 40 against the annular shoulder 15*f* of the guide sleeve 15, the impact-damping surface 35*a* comprising the elastomer material 35 damps the return stroke in the valve body 30 such that, even during the return stroke, vibration or noise are avoided.

The invention has been described above using an example embodiment in which the valve arrangement is designed as a suction valve on the inlet side of the pump 1. It has to be understood that the valve arrangement may also be arranged as a check valve on the outlet side of the pump, wherein the damping arrangement is then provided on the side of the valve seat and the impact-damping surface 35*a* is provided on that side of the valve body which is opposite the valve seat.

What is claimed is:

1. A pump for delivering a fluid, the PUMP comprising:
an electromagnetic drive;
an inlet;
an outlet; and
a delivery chamber,
wherein a suction valve is arranged between the inlet and the delivery chamber,
wherein the suction valve has a valve body with a valve seat pointing in a direction toward the outlet, and a valve member interacting with the valve seat,
wherein the valve member is loaded under prestressing against the valve seat into a closed position of the suction valve and allows fluid to pass through in a pumping direction by the valve member lifting off the valve seat against the prestressing,
wherein the valve body is accommodated in a receptacle in a pump part,
wherein the valve body is assigned a flexible damping arrangement which loads the valve body into a starting position,
wherein the flexible damping arrangement comprises a damping plate being supported against a calking ring,
wherein a piston rod of the electromagnetic drive is axially displaceable in the direction of the valve body,
wherein the flexible damping arrangement allows an axial displacement of the valve body,
wherein the flexible damping arrangement further comprises an elastomeric ring surrounding the valve body and abutting against a flange of the valve body, and
wherein the flexible damping arrangement is arranged in a receptacle of a guide sleeve guiding the piston rod, and wherein the elastomeric ring is supported against an abutment which is mounted in an axially immovable manner with respect to the receptacle.

2. The pump as claimed in claim 1, wherein one of the elastomer ring and at least sections of a casing of the valve body defines a spring.

3. The pump as claimed in claim 1, wherein the flexible damping arrangement further comprises a spring.

4. The pump as claimed in claim 1, wherein the flexible damping arrangement is fixed to the valve body.

5. The pump as claimed in claim 1, wherein the flexible damping arrangement is supported against an abutment which is mounted in an axially immovable manner in the receptacle in the pump part.

* * * * *